US008010275B2

(12) United States Patent
Bauerle et al.

(10) Patent No.: US 8,010,275 B2
(45) Date of Patent: Aug. 30, 2011

(54) SECURED THROTTLE POSITION IN A COORDINATED TORQUE CONTROL SYSTEM

(75) Inventors: Paul A. Bauerle, Fenton, MI (US); Mark H. Costin, Bloomfield Township, MI (US)

(73) Assignee: GM Global Technology Operations LLC

( * ) Notice: Subject to any disclaimer, the term of this patent is extended or adjusted under 35 U.S.C. 154(b) by 628 days.

(21) Appl. No.: 11/950,704

(22) Filed: Dec. 5, 2007

(65) Prior Publication Data

US 2009/0088946 A1 Apr. 2, 2009

Related U.S. Application Data

(60) Provisional application No. 60/976,604, filed on Oct. 1, 2007.

(51) Int. Cl.
*F02D 11/10* (2006.01)

(52) U.S. Cl. ..... 701/102; 701/107; 701/114; 73/114.36; 123/396; 123/399

(58) Field of Classification Search ..... 123/331, 123/336, 396, 399; 701/101, 103, 107, 114–115; 73/114.36

See application file for complete search history.

(56) References Cited

U.S. PATENT DOCUMENTS

| | | | | |
|---|---|---|---|---|
| 3,698,372 | A * | 10/1972 | Eshelman et al. | 123/198 DB |
| 5,575,255 | A * | 11/1996 | Abe et al. | 123/336 |
| 5,686,840 | A * | 11/1997 | Johnson | 324/556 |
| 6,112,148 | A * | 8/2000 | Baraban et al. | 701/107 |
| 6,345,603 | B1 * | 2/2002 | Abboud et al. | 123/397 |
| 6,470,259 | B1 * | 10/2002 | Round | 701/112 |
| 6,513,492 | B1 * | 2/2003 | Bauerle et al. | 123/396 |
| 6,539,299 | B2 * | 3/2003 | Chatfield et al. | 701/104 |
| 6,751,544 | B2 * | 6/2004 | Hashimoto et al. | 701/107 |
| 6,920,851 | B2 * | 7/2005 | Machida et al. | 123/90.16 |
| 7,024,305 | B2 * | 4/2006 | Stamm et al. | 701/114 |
| 7,066,142 | B2 * | 6/2006 | Hanasato | 123/336 |
| 7,287,510 | B2 * | 10/2007 | Costin et al. | 123/336 |
| 7,603,980 | B2 * | 10/2009 | Watanabe | 123/399 |
| 7,717,085 | B1 * | 5/2010 | Bauerle | 123/399 |
| 2003/0182050 | A1 * | 9/2003 | Maegawa et al. | 701/114 |

* cited by examiner

*Primary Examiner* — Thomas N Moulis

(57) ABSTRACT

A throttle control module comprises a primary throttle position module, a redundant throttle position module, and a remedial action module. The primary throttle position module transforms a primary throttle area signal indicating desired throttle area into a primary throttle position signal indicating a first desired throttle position of a throttle valve. The throttle valve is actuated based upon the primary throttle position signal. The redundant throttle position module transforms a redundant throttle area signal indicating desired throttle area into a redundant throttle position signal indicating a second desired throttle position of the throttle valve. The remedial action module selectively generates a remedial action signal based upon a comparison of the first and second desired throttle positions.

11 Claims, 5 Drawing Sheets

SECURED THROTTLE POSITION IN A COORDINATED TORQUE CONTROL SYSTEM

CROSS-REFERENCE TO RELATED APPLICATIONS

This application claims the benefit of U.S. Provisional Patent Application No. 60/976,604, filed on Oct. 1, 2007. The disclosure of the above application is incorporated herein by reference in its entirety.

FIELD

The present disclosure relates to vehicle control systems and more particularly to electronic throttle control.

BACKGROUND

Referring now to FIG. 1, a functional block diagram of a vehicle 100 is presented. The vehicle 100 includes an engine 102, which generates torque to propel the vehicle 100. Air is drawn into the engine 102 through an intake manifold 104. A throttle valve 106 controls airflow into the engine 102. The throttle valve 106 may include a throttle plate 108, which may block all of or a portion of an opening in the throttle valve 106. An electronic throttle control (ETC) motor 109 controls the throttle valve 106 and/or the throttle plate 108.

The air flowing through the throttle valve 106 is mixed with fuel from one or more fuel injectors 110 to form an air-fuel mixture. The air-fuel mixture is combusted within one or more cylinders 112 of the engine 102. Combustion of the air-fuel mixture may be initiated by, for example, a spark delivered by a spark plug 114. Although the spark plug 114 is depicted, the engine 102 may include a compression-combustion type engine that does not include the spark plug 114. The combustion of the air-fuel mixture generates torque. Resulting exhaust gas is expelled from the cylinders 112 to an exhaust system 116.

An engine control module (ECM) 130 modulates torque output from the engine 102. The ECM 130 may modulate torque by controlling the airflow through the throttle valve 106, the fuel injected by the fuel injectors 110, and/or the timing of the spark delivered by the spark plug 114. The ECM 130 may modulate torque based upon, for example, a pedal position signal from a pedal position sensor 134 and/or signals from other sensors 136. The pedal position sensor 134 generates the pedal position signal based upon actuation of an accelerator pedal 138 by a driver. The other sensors 136 may include, for example, a mass air flow (MAF) sensor, a manifold absolute pressure (MAP) sensor, an engine speed sensor, a transmission sensor, a cruise control system, and/or a traction control system.

SUMMARY

A throttle control module comprises a primary throttle position module, a redundant throttle position module, and a remedial action module. The primary throttle position module transforms a primary throttle area signal indicating desired throttle area into a primary throttle position signal indicating a first desired throttle position of a throttle valve. The throttle valve is actuated based upon the primary throttle position signal. The redundant throttle position module transforms a redundant throttle area signal indicating desired throttle area into a redundant throttle position signal indicating a second desired throttle position of the throttle valve. The remedial action module selectively generates a remedial action signal based upon a comparison of the first and second desired throttle positions.

A throttle control system comprises the throttle control module and a throttle actuation module. The throttle actuation module controls an electronic throttle control (ETC) motor that actuates the throttle valve. The throttle actuation module instructs the ETC motor to actuate the throttle valve to a predetermined throttle position after receiving the remedial action signal. In further features, the predetermined throttle position is a high-idle position.

In other features, the throttle actuation module instructs the ETC motor to actuate the throttle valve to a lesser throttle position after receiving the remedial action signal. The lesser throttle position is one of the first and second desired throttle positions that corresponds to a lesser opening of the throttle valve.

In further features, the throttle actuation module compares the first desired throttle position with an actual throttle position from a throttle position sensor and instructs the ETC motor to actuate the throttle valve to reach the first desired throttle position based upon the comparison.

In still further features, the throttle control module further comprises nonvolatile memory that includes data for converting throttle area to throttle position. The primary and redundant throttle position modules determine the first and second desired throttle positions, respectively, based upon the data. The data comprises a first lookup table and a second lookup table. The first lookup table has a mapping from throttle area to segment value. The second lookup table has a mapping from segment value to throttle position.

In still further features, the remedial action module suspends generating the remedial action signal when a service input signal is received. The remedial action module generates the remedial action signal when the first and second desired throttle positions differ by more than a predetermined percentage. The predetermined percentage corresponds to a maximum allowable calculation imprecision.

A method comprises transforming a primary throttle area signal indicating desired throttle area into a primary throttle position signal indicating a first desired throttle position of a throttle valve, actuating the throttle valve based upon the primary throttle position signal, transforming a redundant throttle area signal indicating desired throttle area into a redundant throttle position signal indicating a second desired throttle position of the throttle valve, and selectively generating a remedial action signal based upon a comparison of the first and second desired throttle positions.

In further features, the method further comprises actuating the throttle valve to a predetermined throttle position after receiving the remedial action signal. The predetermined throttle position is a high-idle position. The method further comprises actuating the throttle valve to a lesser throttle position after receiving the remedial action signal. The lesser throttle position is one of the first and second desired throttle positions that corresponds to a lesser opening of the throttle valve.

In other features, the method further comprises comparing the first desired throttle position with an actual throttle position from a throttle position sensor and actuating the throttle valve to reach the first desired throttle position based upon the comparison. The method further comprises determining the first and second throttle positions based upon data for converting throttle area to throttle position.

In still other features, the method further comprises determining the first and second throttle positions based upon a first lookup table and a second lookup table. The first lookup table has a mapping from throttle area to segment value. The second lookup table has a mapping from segment value to throttle position.

The method further comprises suspending generating the remedial action signal when a service input signal is received. The method further comprises generating the remedial action signal when the first and second desired throttle positions differ by more than a predetermined percentage.

Further areas of applicability of the present disclosure will become apparent from the detailed description provided hereinafter. It should be understood that the detailed description and specific examples, while indicating the preferred embodiment of the disclosure, are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
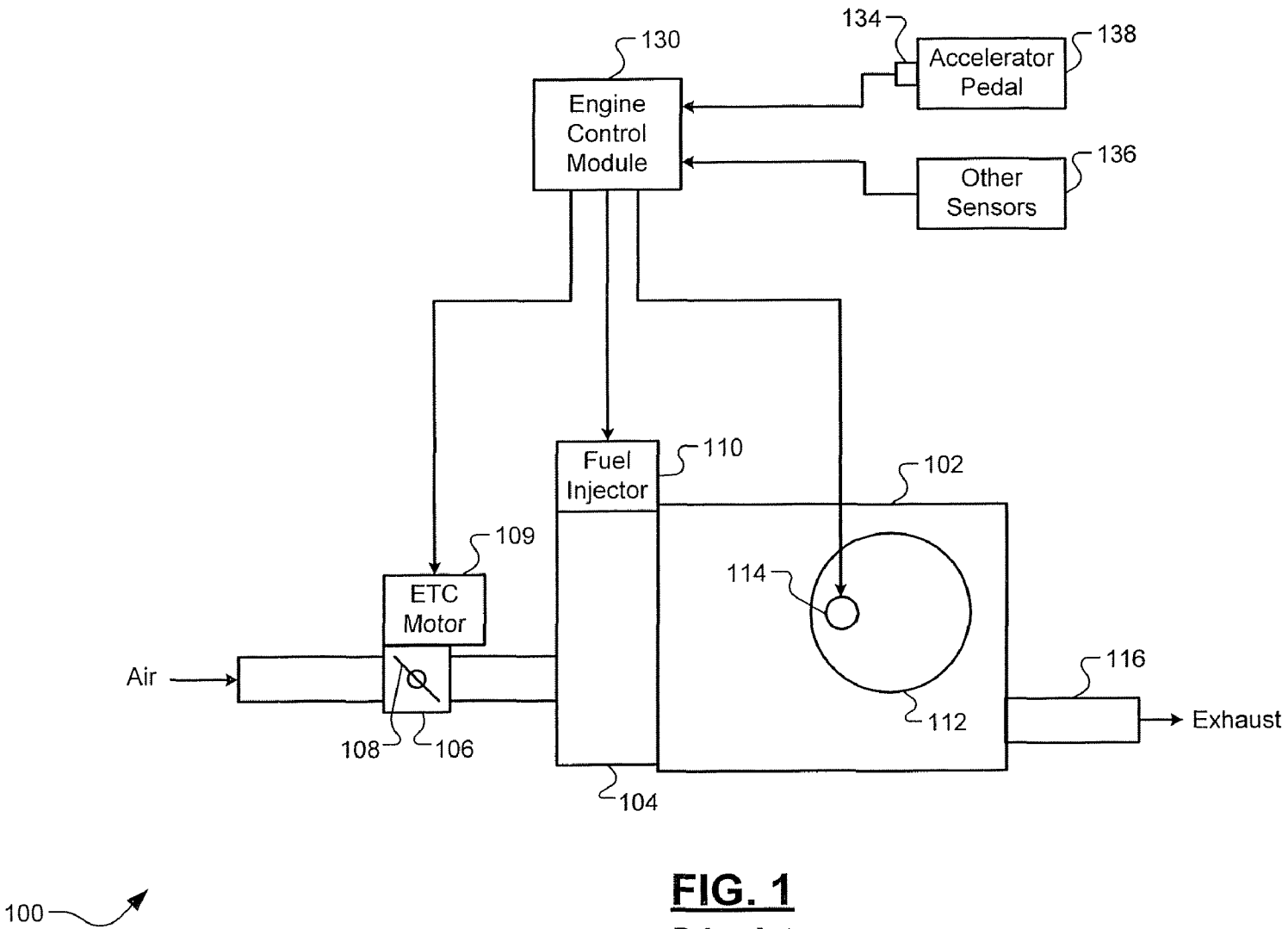
FIG. 1 Prior Art
FIG. 1 is a functional block diagram of a vehicle according to the prior art.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

Figure 2:
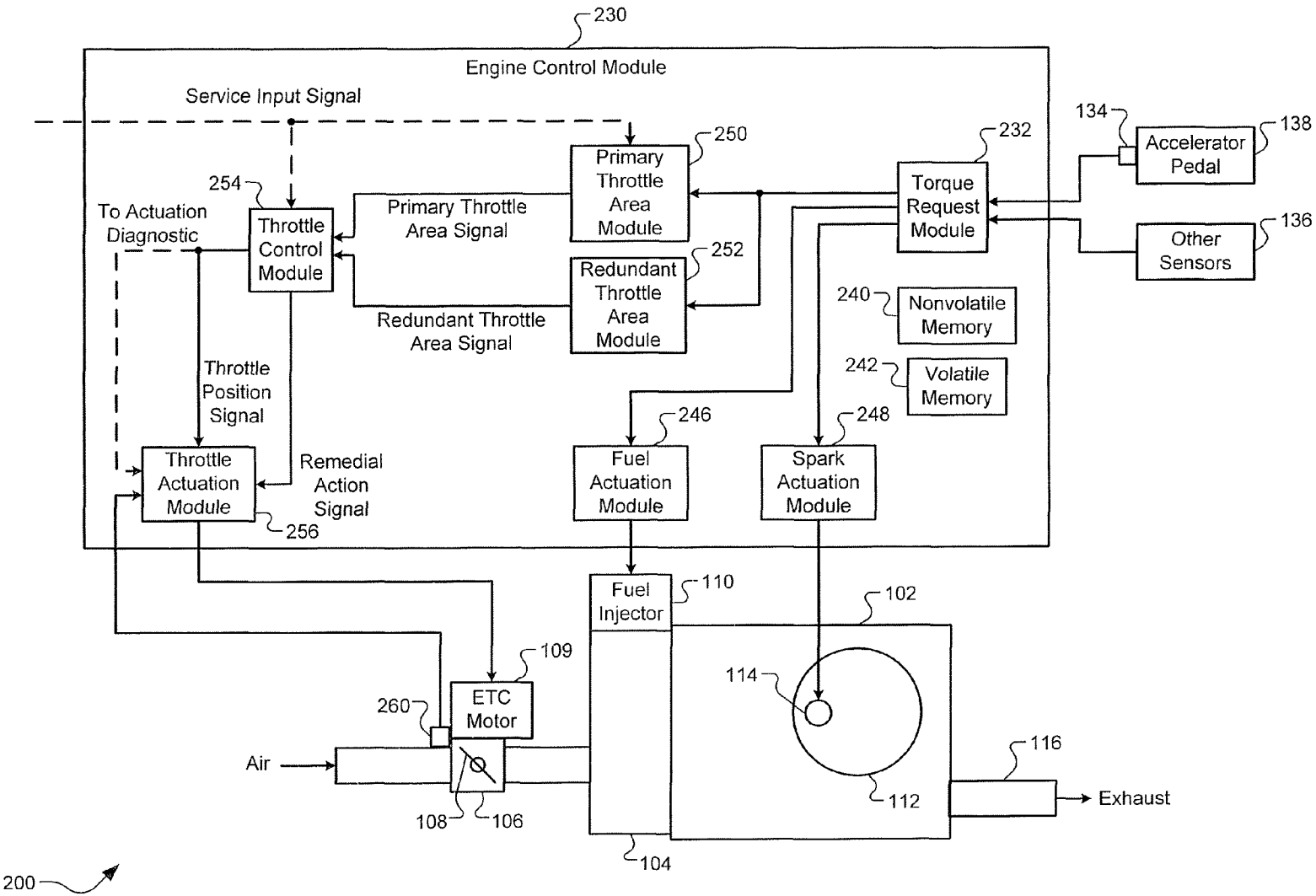
FIG. 2 is a functional block diagram of an exemplary vehicle according to the principles of the present disclosure.

Referring now to FIG. 2, a functional block diagram of an exemplary vehicle 200 is presented. The vehicle 200 includes the engine 102, which generates torque to propel the vehicle 200. An engine control module (ECM) 230 modulates torque output from the engine 102. The ECM 230 may modulate torque by controlling the airflow through the throttle valve 106, the fuel injected by the fuel injectors 110, and/or the timing of the spark delivered by the spark plug 114.

The ECM 230 includes a torque request module 232, a fuel actuation module 246, a spark actuation module 248, a primary throttle area module 250, and a redundant throttle area module 252. The torque request module 232 generates a torque request based upon, for example, the pedal position signal from the pedal position sensor 134 and/or signals from the other sensors 136. The torque request module 232 may also generate the torque request based upon data stored in memory, such as nonvolatile memory 240 and volatile memory 242. For example only, the nonvolatile memory 240 may be read-only memory (ROM), flash memory, electrically erasable programmable read-only memory (EEPROM), erasable programmable read-only memory (EPROM) or any other suitable type of nonvolatile memory.

Based on the torque request, the torque request module 232 transmits control signals to the fuel actuation module 246, the spark actuation module 248, and the primary throttle area module 250. The control signal for the primary throttle area module 250 is also provided to the redundant throttle area module 252. The fuel actuation module 246 controls the volume of fuel injected by the fuel injectors 110. The spark actuation module 248 controls the timing of spark delivery of the spark plug 114.

The primary throttle area module 250 generates a primary throttle area signal based upon the control signal from the torque request module 232. The primary throttle area signal may also be based upon data stored in memory, such as the nonvolatile memory 240 and the volatile memory 242. The primary throttle area signal indicates the desired throttle area of the throttle valve 106. The desired throttle area may be, for example, a desired percentage of the throttle valve opening that is unblocked by the throttle plate 108 or a desired physical area of the throttle valve opening.

Independent of the primary throttle area signal, the redundant throttle area module 252 generates a redundant throttle area signal, which also indicates the desired throttle area of the throttle valve 106. The redundant throttle area module 252 generates the redundant throttle area signal based upon the control signal from the torque request module 232. The redundant throttle area module 252 may also generate the redundant throttle area signal based upon data stored in the nonvolatile memory 240 and the volatile memory 242.

The throttle area of the throttle valve 106 may be controlled by the position of the throttle plate 108, which is referred to as throttle position. In various implementations, the throttle position represents an angular position of the throttle plate 108 on a rotational axis perpendicular to the direction of airflow through the throttle valve 106. For example only, a throttle area opening percentage of 50% may correspond to a throttle position of 30°.

A throttle control module 254 receives the primary throttle area signal and the redundant throttle area signal. Although the throttle control module 254 and other modules are depicted within the ECM 230, one or more may be implemented separately from the ECM 230. The throttle control module 254 transmits a throttle position signal to a throttle actuation module 256. The throttle actuation module 256 drives the ETC motor 109 to actuate the throttle plate 108 to the position indicated by the throttle position signal.

The throttle control module 254 generates a primary throttle position signal based upon the primary throttle area signal and a redundant throttle position signal based upon the redundant throttle area signal. The primary and redundant throttle position signals indicate desired throttle position. If the primary and redundant throttle position signals differ, the throttle control module 254 may take remedial action.

To take remedial action, the throttle control module 254 may transmit a remedial action signal to the throttle actuation module 256. When the throttle actuation module 256 receives the remedial action signal, the throttle actuation module 256 may, for example, instruct the ETC motor 109 to actuate the throttle plate 108 to a predetermined throttle position. The predetermined throttle position may be a high-idle position.

Alternatively, the throttle actuation module 256 may instruct the ETC motor 109 to actuate the throttle plate 108 to the throttle position corresponding to the lesser of the primary and redundant throttle position signals. In this manner, the throttle control module 254 prevents an unexpected increase in torque in the event that one of the primary or redundant throttle position signals is corrupt.

The throttle actuation module 256 may include an actuation diagnostic, which compares the desired throttle position with an actual throttle position. The actual throttle position may be measured by one or more throttle position sensors 260. If the desired throttle position differs from the actual throttle position, the throttle actuation module 256 may attempt to control the ETC motor 109 to reach the desired throttle position. The throttle actuation module 256 may also signal an error and/or instruct the ETC motor 109 to actuate the throttle plate 108 to the high-idle throttle position.

A service input signal may be transmitted to the primary throttle area module 250 and the throttle control module 254 by, for example, a service technician or a calibrator. The service input signal may instruct the primary throttle area module 250 to generate the primary throttle area signal based upon the service input signal. The primary throttle area signal will likely then differ from the redundant throttle area signal, which may cause the throttle control module 254 to incorrectly take remedial action. Accordingly, the throttle control module 254 may refrain from taking remedial action when the service input signal is received.

Figure 3A:
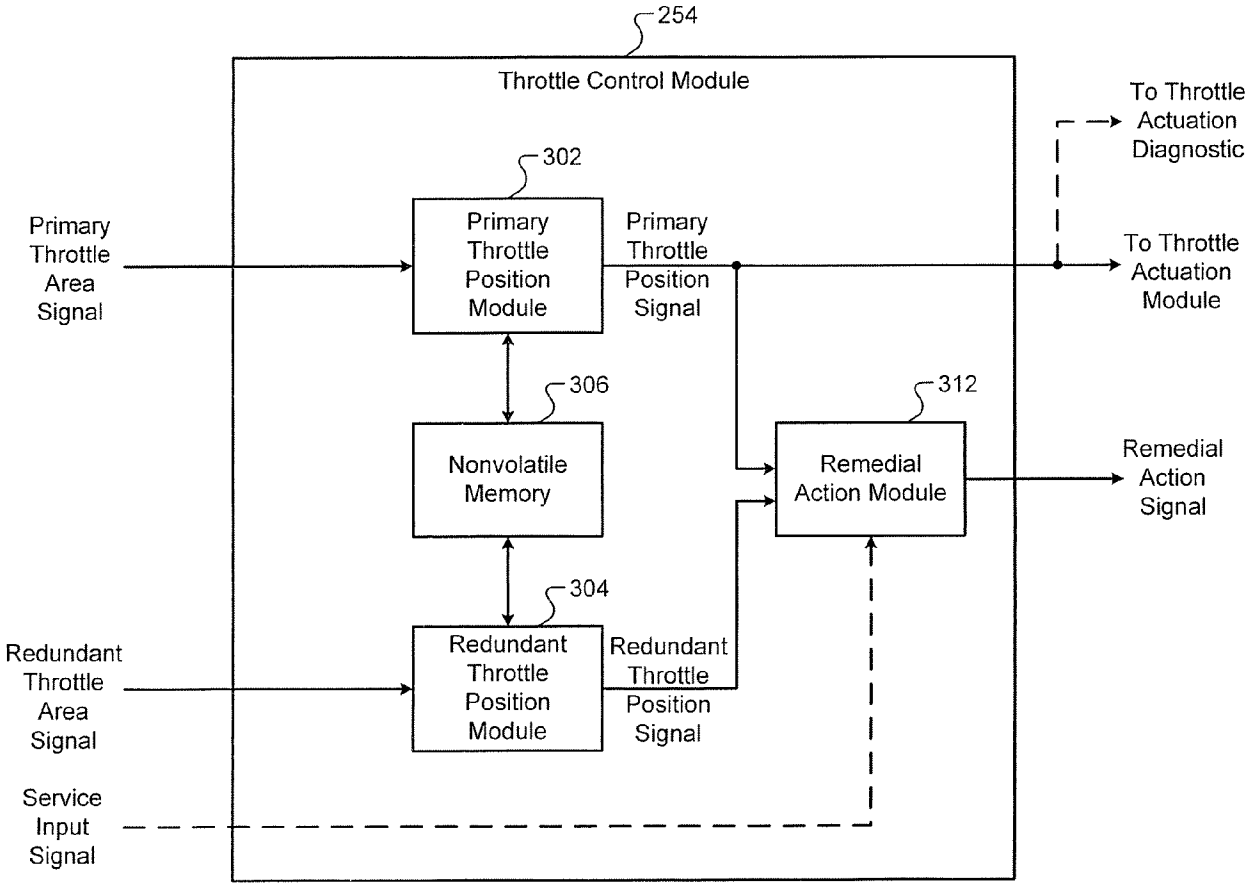
FIG. 3A is a functional block diagram of an exemplary throttle control module according to the principles of the present disclosure.

Referring now to FIG. 3A, a functional block diagram of an exemplary implementation of the throttle control module 254 is presented. The throttle control module 254 includes a primary throttle position module 302 and a redundant throttle position module 304, which receive the primary throttle area signal and the redundant throttle area signal, respectively.

The primary throttle position module 302 generates a primary throttle position signal based upon the primary throttle area signal. The redundant throttle position module 304 generates a redundant throttle position signal based upon the redundant throttle area signal. The primary throttle position signal and the redundant throttle position signal each indicate a desired throttle position.

The desired throttle positions may be determined using throttle area to throttle position data stored in nonvolatile memory 306. The nonvolatile memory 306 may be implemented in the nonvolatile memory 240 of FIG. 2. and may include, for example, a diagnostic or an error correcting code (ECC) to ensure data integrity. For example only, the nonvolatile memory 306 may be may be read-only memory (ROM), flash memory, electrically erasable programmable read-only memory (EEPROM), erasable programmable read-only memory (EPROM) or any other suitable type of nonvolatile memory.

Figure 3B:
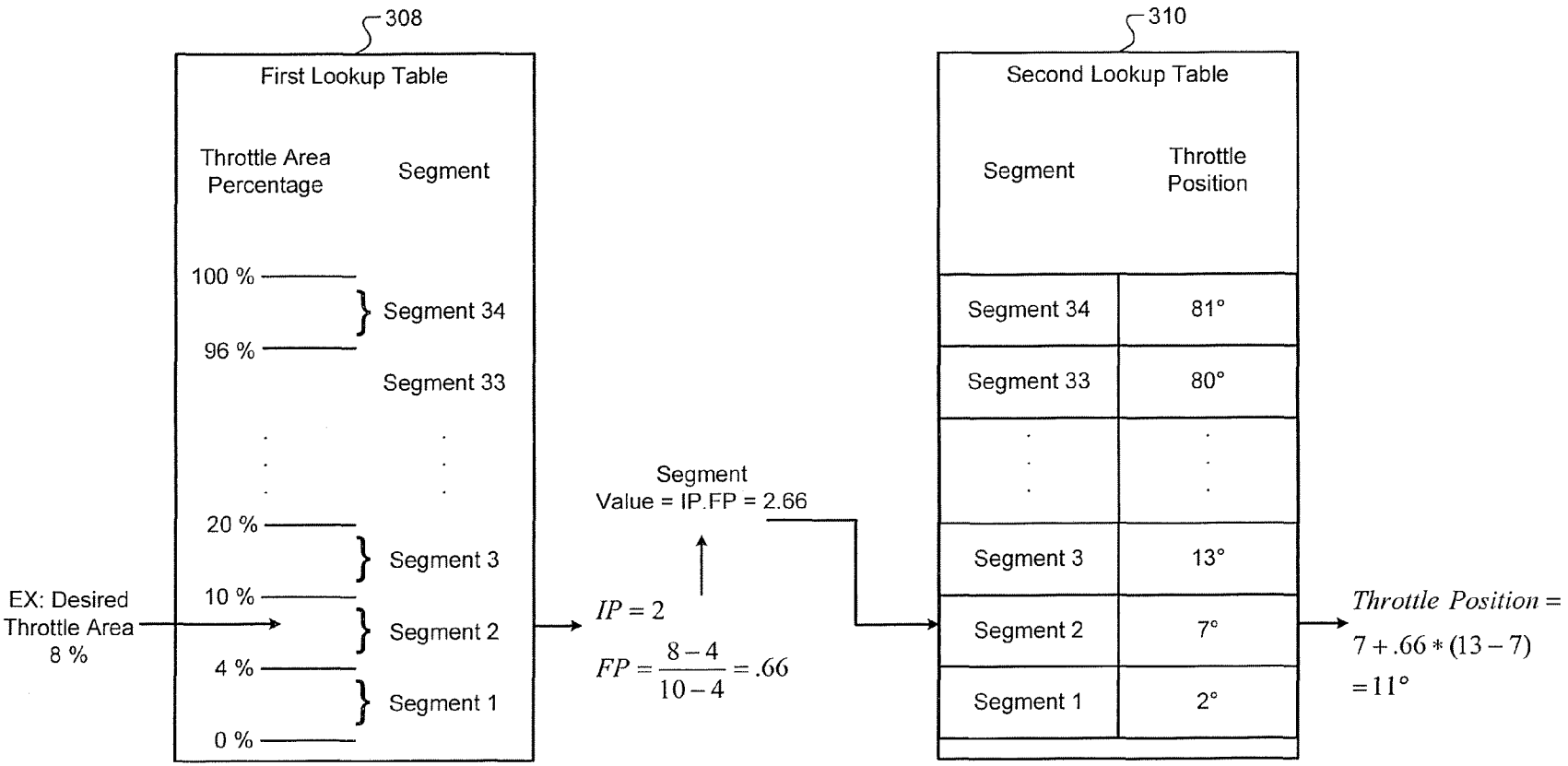
FIG. 3B is an exemplary tabular illustration of lookup tables used to convert a desired throttle area percentage into a desired throttle position according to the principles of the present disclosure.

The nonvolatile memory 306 may include one or more lookup tables from which a desired throttle position (e.g., in degrees of throttle plate rotation) may be determined from a desired throttle area (e.g., in percentage of unrestricted throttle valve area). Referring to FIG. 3B, an exemplary tabular illustration of lookup tables used to convert a desired throttle area percentage into a desired throttle position is presented. Numerical values and calculations in FIG. 3B are provided for exemplary purposes only, and the lookup tables may include any suitable values.

In various implementations, the range of possible throttle areas (e.g., 0-100%) may be divided into a predetermined number of segments, such as 33 segments. These segments may be equally or unequally sized. When the range of possible throttle areas is divided into 33 equally sized segments, each segment includes approximately 3.3% of the range of throttle areas (i.e., 100%/33 segments).

A first lookup table 308 may define each segment in terms of the maximum throttle area within the segment. A segment value for a desired throttle area may be determined based upon the first lookup table 308. The segment value may include an integer part (IP) and a fractional part (FP), and may be represented as IP.FP. The first lookup table 308 may be used to determine in which segment the desired throttle area is located, IP, and where within segment IP the desired throttle area is located, FP. In various implementations, FP may not be determined.

The desired throttle area may fall between a first and a second maximum throttle area $MTA_1$ and $MTA_2$, respectfully. $MTA_1$ and $MTA_2$ correspond to upper and lower segments IP and IP-1, respectively. For example only, the FP may be calculated through interpolation, such as linear interpolation, using the equation:

$$FP = \left(\frac{\text{Desired Throttle Area} - MTA_2}{MTA_1 - MTA_2}\right)$$

where $MTA_1$ is the maximum throttle area corresponding to IP, and $MTA_2$ is the maximum throttle area corresponding to IP-1.

For purposes of illustration and example only, in FIG. 3B, a desired throttle area percentage of 8% falls between maximum throttle area percentages of 10% and 4%, which are $MTA_1$ and $MTA_2$, respectively. $MTA_1$ and $MTA_2$ correspond to segment 2 (i.e. IP) and segment 1 (i.e., IP-1), respectively. Using the equation above and the exemplary values provided, FP can be determined and is 0.66 in FIG. 3B.

A second lookup table 310 is used to determine the desired throttle position that corresponds to the segment value IP.FP. The second lookup table 310 includes a mapping of segment to throttle position. IP and an upper segment IP+1 correspond to lower and upper throttle positions $TP_1$ and $TP_2$, respectively. For example only, the desired throttle position that corresponds to the desired throttle area may be calculated through interpolation, such as linear interpolation, using FP and the equation:

$$\text{Desired Throttle Position} = TP_1 + FP*(TP_2 - TP_1)$$

where $TP_1$ is the throttle position corresponding to IP, $TP_2$ is the throttle position corresponding to IP+1, and FP is the fractional part of the segment value.

For purposes of illustration and example only, in FIG. 3B, the segment value 2.66 (from above) corresponds to IP (segment 2). IP and IP+1 (segment 3) correspond to throttle positions of 7° and 13°, respectively. Using the above equation and the exemplary values provided, the desired throttle position can be determined and is 11° in FIG. 3B. Accordingly, using the exemplary values provided, a desired throttle area percentage of 8% may correspond to a desired throttle position of 11°.

Referring back to FIG. 3A, the desired throttle positions may be expressed as voltages within a voltage range. A lower limit of the voltage range may be learned upon starting the engine 102. For example only, the lower limit may be learned based upon a minimum throttle position measured by the throttle position sensor 260. An upper limit of the voltage range may be calibratable. For example only, the upper limit may be set to correspond to the greatest allowable throttle position.

The primary throttle position module 302 transmits the primary throttle position signal to the throttle actuation module 256 and may transmit the primary throttle position signal to the throttle actuation diagnostic. A remedial action module 312 determines whether to take remedial action based upon a comparison of the primary and redundant throttle position signals and generates the remedial action signal accordingly.

The remedial action module 312 may take remedial action when, for example, the desired throttle positions differ by more than a predetermined percentage. The predetermined percentage may allow for rounding errors, and may be, for example, 0.06%. Alternatively, taking remedial action may be limited to times when the desired throttle position of the primary throttle position signal is larger than that of the redundant throttle position signal by more than the predetermined percentage.

The remedial action module 312 may also receive the service input signal. The remedial action module 312 may further limit taking remedial action to times when the service input signal is not received. This may prevent the incorrect taking of remedial action when the primary throttle area signal is being generated based upon the service input signal.

The throttle actuation module 256 may, for example, instruct the ETC motor 109 to actuate the throttle plate 108 to the predetermined throttle position when the remedial action signal is received. In this manner, the throttle control module 254 prevents an unexpected increase in torque in the event that one of the primary or redundant throttle position signals is corrupt. The remedial action signal may also be transmitted to other components of the ECM 230 for diagnostic purposes. For example only, the ECM 230 may illuminate a "check engine" light and/or set an error code after receiving the remedial action signal.

Figure 4:
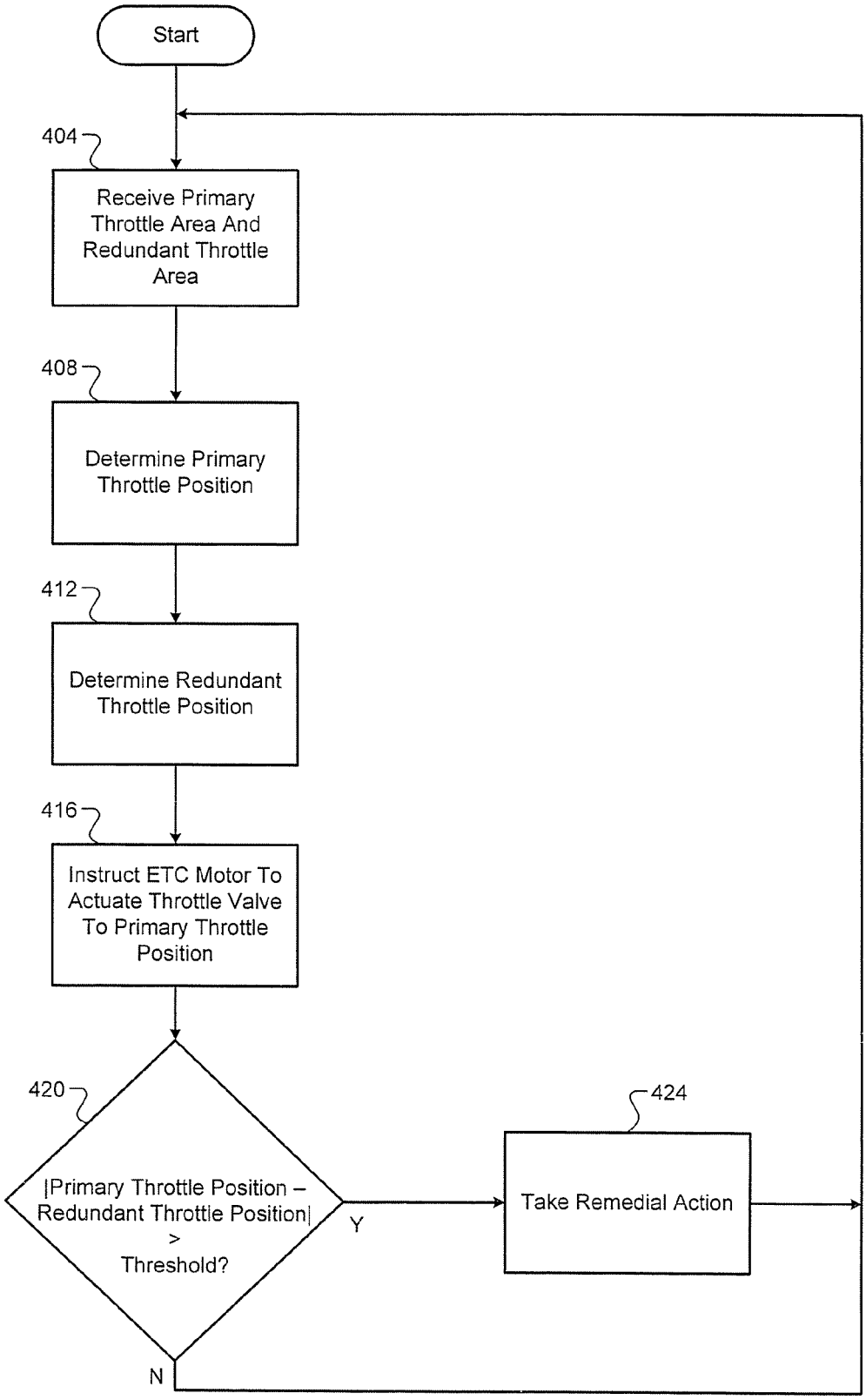
FIG. 4 is a flowchart depicting exemplary steps performed by a throttle control module according to the principles of the present disclosure.

Referring now to FIG. 4, a flowchart depicting exemplary steps performed by the throttle control module 254 is presented. Control begins in step 404, where control receives the primary throttle area signal and the redundant throttle area signal. The primary throttle area signal and the redundant throttle area signal each indicate the desired throttle area.

Control continues in step 408, where control determines the primary throttle position and generates the primary throttle position signal accordingly. Control continues in step 412, where control determines the redundant throttle position and generates the redundant throttle position signal accordingly. Control may, for example, convert the desired throttle areas of the primary and redundant throttle area signals to the desired throttle positions using the lookup tables of the nonvolatile memory 306.

Control continues in step 416, where control instructs the ETC motor 109 to actuate the throttle plate 108 to the throttle position indicated by the primary throttle position signal. In step 420, control determines whether the throttle positions indicated by the primary and redundant throttle position signals differ by more than the predetermined percentage. If so, control transfers to step 424; otherwise, control returns to step 404. In step 424, control takes remedial action. For example only, control may take remedial action by instructing the ETC motor 109 to actuate the throttle plate 108 to a predetermined throttle position, such as the high-idle position. Control then returns to step 404.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification and the following claims.

What is claimed is:

1. A throttle control module comprising:

a primary throttle position module that transforms a primary throttle area signal indicating desired throttle area into a primary throttle position signal indicating a first desired throttle position of a throttle valve, wherein said throttle valve is actuated based upon said primary throttle position signal;

a redundant throttle position module that transforms a redundant throttle area signal indicating desired throttle area into a redundant throttle position signal indicating a second desired throttle position of said throttle valve; and a remedial action module that selectively generates a remedial action signal based upon a comparison of said first and second desired throttle positions, wherein said remedial action module suspends generating said remedial action signal when a service input signal is received.

2. A method comprising:

transforming a primary throttle area signal indicating desired throttle area into a primary throttle position signal indicating a first desired throttle position of a throttle valve;

actuating said throttle valve based upon said primary throttle position signal;

transforming a redundant throttle area signal indicating desired throttle area into a redundant throttle position signal indicating a second desired throttle position of said throttle valve;

selectively generating a remedial action signal based upon a comparison of said first and second desired throttle positions; and suspending said generating said remedial action signal when a service input signal is received.

3. The method of claim 2 further comprising transforming said first and second throttle area signals into said first and second throttle position signals based upon a first lookup table having a mapping from throttle area to segment value and a second lookup table having a mapping from segment value to throttle position.

4. The method of claim 2 further comprising actuating said throttle valve to a predetermined throttle position after said remedial action signal is generated, wherein said predetermined throttle position is a high-idle position.

5. The method of claim 2 further comprising actuating said throttle valve to a lesser throttle position after said remedial action signal is generated, wherein said lesser throttle position is one of said first and second desired throttle positions that corresponds to a lesser opening of said throttle valve.

6. The method of claim 2 further comprising generating said remedial action signal when said remedial action signal is not generated and said first and second desired throttle positions differ by more than a predetermined percentage, wherein said predetermined percentage corresponds to a maximum allowable calculation imprecision.

7. The throttle control module of claim 1 further comprising nonvolatile memory that includes data for transforming throttle area to throttle position, wherein said primary and redundant throttle position modules transform said first and second desired throttle positions, respectively, based upon said data.

8. The throttle control module of claim 7 wherein said data comprises:

a first lookup table having a mapping from throttle area to segment value; and a second lookup table having a mapping from segment value to throttle position.

9. The throttle control module of claim 1 further comprising a throttle actuation module that controls an electronic throttle control (ETC) motor that actuates said throttle valve, wherein said throttle actuation module instructs said ETC motor to actuate said throttle valve to a predetermined throttle position after said remedial action signal is generated, and wherein said predetermined throttle position is a high-idle position.

10. The throttle control module of claim 1 further comprising a throttle actuation module that controls an electronic throttle control (ETC) motor that actuates said throttle valve, wherein said throttle actuation module instructs said ETC motor to actuate said throttle valve to a lesser throttle position said remedial action signal is generated, and wherein said lesser throttle position is one of said first and second desired throttle positions that corresponds to a lesser opening of said throttle valve.

11. The throttle control module of claim 1 wherein said remedial action module generates said remedial action signal when said first and second desired throttle positions differ by more than a predetermined percentage, and wherein said predetermined percentage corresponds to a maximum allowable calculation imprecision.

* * * * *